United States Patent [19]

Palka

[11] 4,069,450

[45] Jan. 17, 1978

[54] KNOCKDOWN CABINET HAVING A COMBINATION DOOR FRAME AND FRONT WALL

[75] Inventor: James J. Palka, Arlington Heights, Ill.

[73] Assignee: General Bathroom Products Corporation, Elk Grove Village, Ill.

[21] Appl. No.: 760,758

[22] Filed: Jan. 19, 1977

[51] Int. Cl.[2] ..... A47B 47/04

[52] U.S. Cl. ..... 312/257 R; 16/128 R; 49/236; 312/199; 312/294

[58] Field of Search ..... 312/257 R, 257 SK, 294, 312/263, 198, 199, 228

[56] References Cited

U.S. PATENT DOCUMENTS

| | | | |
|---|---|---|---|
| 3,063,768 | 11/1962 | Moore, Sr. | 312/198 |
| 3,784,273 | 1/1974 | Nikolai | 312/257 R |
| 3,844,634 | 10/1974 | Kruger et al. | 312/257 R |
| 3,877,765 | 4/1975 | Hassing | 312/257 R |

*Primary Examiner*—Paul R. Gilliam
*Assistant Examiner*—Alex Grosz
*Attorney, Agent, or Firm*—Rummler & Snow

[57] ABSTRACT

This invention relates to a knockdown cabinet and particularly to a one-piece molded plastic door frame and front wall having unique means for hinging the doors to the cabinet frame opening.

8 Claims, 13 Drawing Figures

FIG. 1
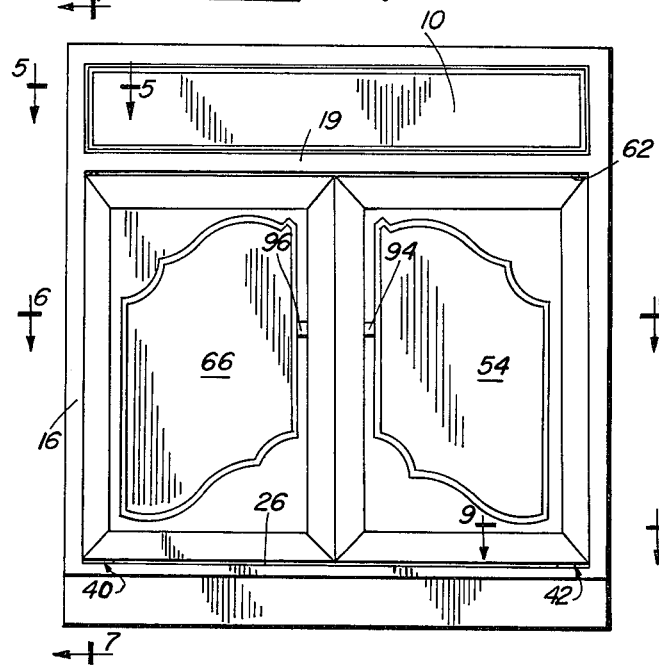
FIG. 2
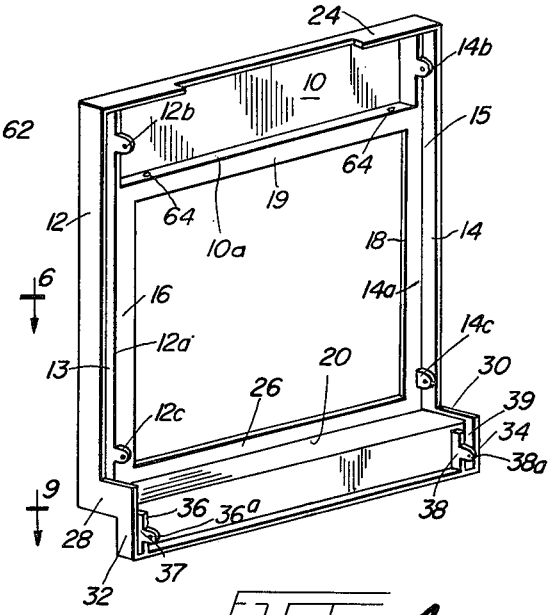
FIG. 3
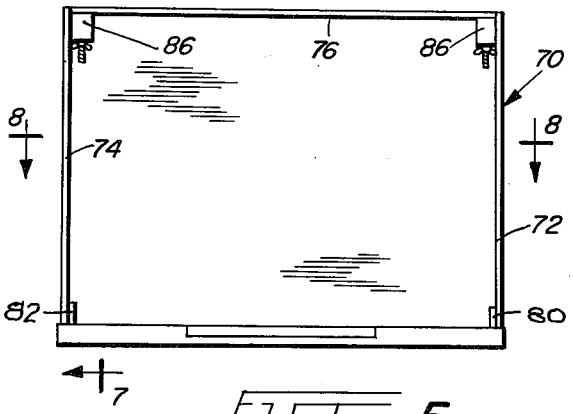
FIG. 4
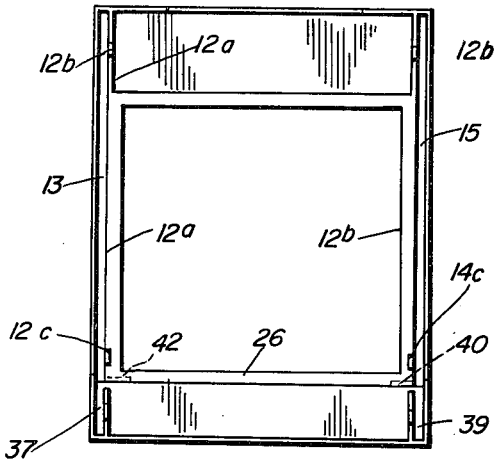
FIG. 5
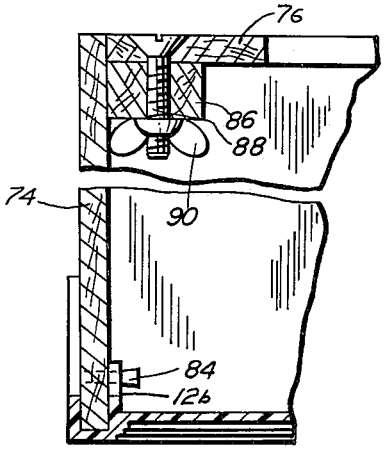
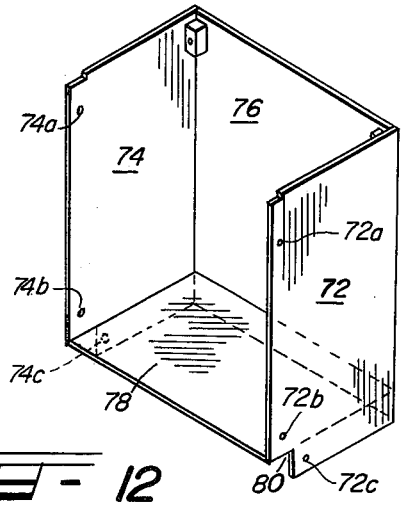
FIG. 12

FIG. 6
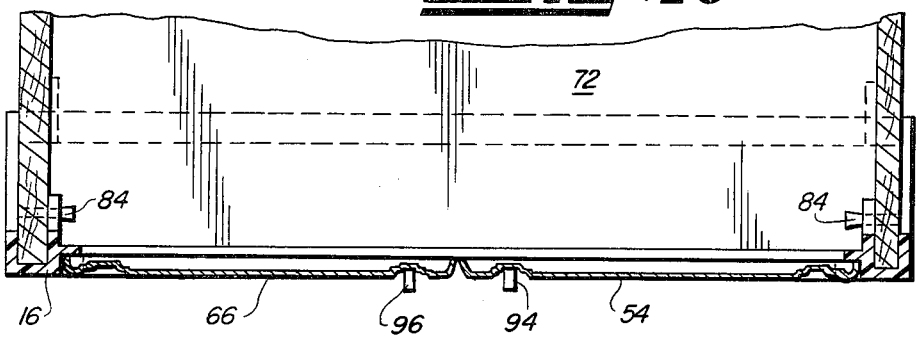
FIG. 7
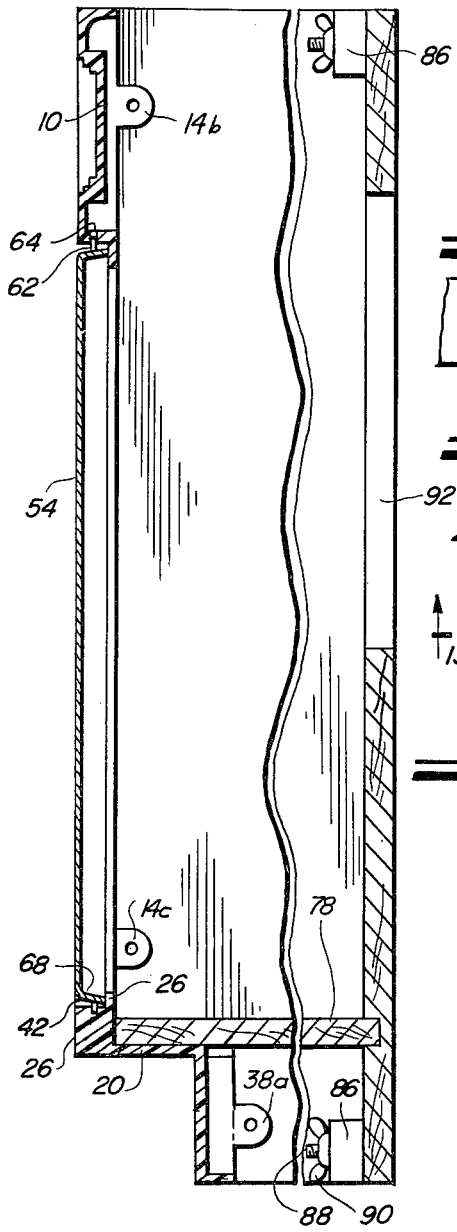
FIG. 8
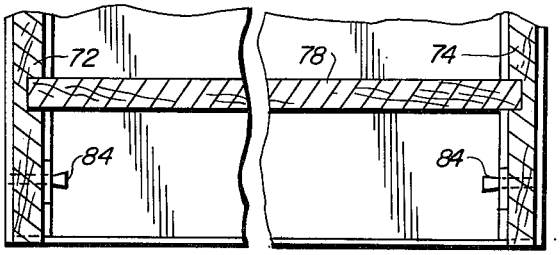
FIG. 13
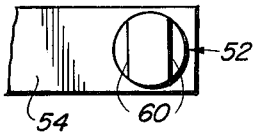
FIG. 9
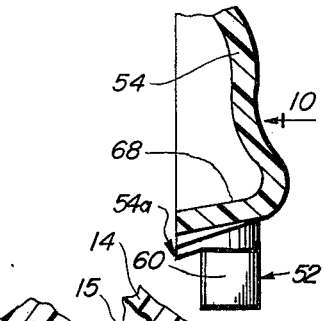
FIG. 10
FIG. 11
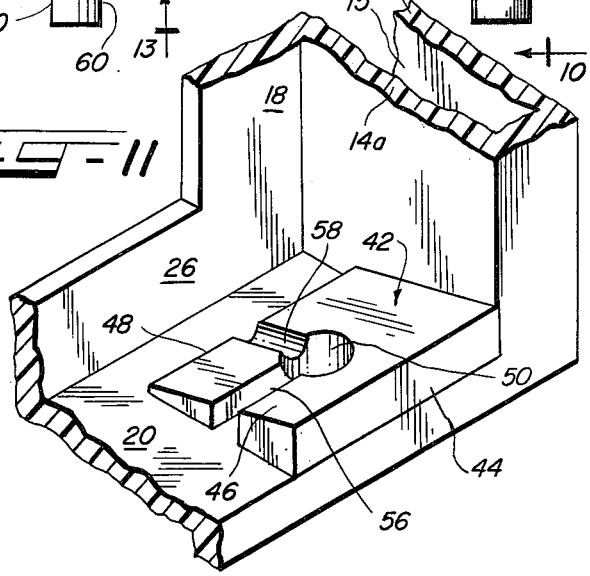

KNOCKDOWN CABINET HAVING A COMBINATION DOOR FRAME AND FRONT WALL

SUMMARY OF THE INVENTION

A simple molded one-piece door frame and front wall for a cabinet uniquely suited for ready attachment to the top, bottom and side walls of a cabinet, having new, original and novel means for removably securing the door panels to said frame by means of pivot rods and retaining them in closed position by said means and yet each door panel may be pivotally opened and may be intentionally removed if desired.

BRIEF DESCRIPTION OF THE DRAWINGS

FIG. 1 is a front elevational view of a cabinet;

FIG. 2 is a rear perspective view of the plastic door frame and cabinet front;

FIG. 3 is a top elevational view of the device of FIG. 1 with the cabinet top removed;

FIG. 4 is a rear elevational view of the frame of FIG. 2;

FIG. 5 is a cross-sectional view taken on the line 5—5 of FIG. 1;

FIG. 6 is a cross-sectional view taken on the line 6—6 of FIG. 1; FIG. 7 is a cross-sectional view taken on the line 7—7 of FIG. 3;

FIG. 8 is a cross-sectional view taken on lines 8—8 of FIG. 3;

FIG. 9 is an enlarged cross-sectional view taken on the line 9—9 of FIG. 1 showing the pivot pin on the lower end of the door;

FIG. 10 is an enlarged cross-sectional view taken on the lines 10—10 of FIG. 9;

FIG. 11 is an enlarged perspective view of the pivot bracket;

FIG. 12 is a perspective view of the cabinet structure; and

FIG. 13 is an elevational view taken on lines 13—13 of FIG. 10.

THE PREFERRED EMBODIMENT

The knockdown cabinet of this invention is primarily directed to the combination of front wall and door frame such as shown in FIGS. 2, 4 and 10, in combination with a knockdown cabinet structure.

The one-piece door frame and front wall of the cabinet is molded plastic, preferably from high impact polystyrene, and comprises an upper front wall portion 10, an intermediate horizontal wall 10*a*, integrally formed side walls 12, 14, and a rearwardly extending, horizontally offset, wide bottom wall 20. Each wall 12, 14 is a double wall with the inner walls 12*a* and 14*a* spaced inwardly from the inner faces of said outer walls 12, 14 to form vertically extending grooves 13, 15. The frame is also provided with a doorway, formed by inwardly extending side, top and bottom members 16, 18, 19 and 26, respectively, formed on the rear margins of inner walls 12*a* and 14*a* and intermediate wall 10*a*.

The walls 12, 14 are also provided at their lower ends with integrally formed, horizontally positioned walls 28 and 30 offset from the lower ends of outer walls 12, 14 and vertical walls 32, 34, respectively, depending from the rear margins of said offset walls 28, 30. Inner walls 36, 38 extend inwardly from the wall 22 and are spaced from the inner margins of walls 32, 34 to form vertically extending grooves 37, 39. The inner walls 12*a*, 14*a*, 36 and 38 are provided with rearwardly extending ears 12*b*, 12*c*, 14*b*, 14*c*, 36*a* and 38*a* and each ear contains a perforation, the purpose of which will hereinafter be explained.

Adjacent each side wall 12, 14 is lower door pivot bracket and positioning means 40, 42. (See FIG. 11.) Each pivot bracket extends upwardly from the upper face of the bottom wall 20 in front of lower wall 26 of the frame, as shown in FIG. 11, and extends inwardly from inner side walls 12*a* and 14*a*. The brackets 40, 42 are molded separately and snap fitted in place in a groove, not shown, in the wall 20.

Since the pivot brackets 40, 42 are identical but mirror images of each other, only one will be explained.

The front face 44 extends approximately one-quarter of an inch above the bottom wall 20 and tapers inwardly and downwardly therefrom at about a 15° angle. Thus the rear end 48 of the face 46 blends with the wall 20 and is spaced apart from the lower margin of inner bottom member 26. An aperture 50 extends from the face 46 vertically downwardly to receive the pivot 52 of the door 54.

A pair of right angled grooves 56, 58 extend one rearwardly and the other inwardly from the aperture 50. As noted in the drawing, the groove 58 is wider than the groove 56.

The lower door pivot 52 is generally cylindrical with the lower portion having opposed flat side faces 60. (See FIGS. 9 and 13.) The upper door pivot 62 is cylindrical and is aligned with the lower door pivot 50. An appropriate perforation 64 is positioned in the intermediate wall 10*a* to receive the pivot 62.

The doors 54, 66 are identical except one is a mirror image of the other and hence only one will be described.

With reference to FIG. 9, it will be seen that the lower end 68 is tapered rearwardly and downwardly generally conforming to the face 46 of bracket 42 but generally spaced therefrom. There is provided a space between the upper end of door 54 and the lower face of intermediate horizontal wall 10*a*. Thus the height of the door is less than the door frame height. This is required so that when the door is in fully open position, the door may be shifted upwardly and the pivot 52 is now in position as shown in FIG. 9 with the flattened portions 60 of the pivot ready for shifting inwardly in groove 58. The pivot 52 will readily shift rearwardly towards the lower wall 26 of the frame through the groove 58 and then, when moved, at right angles laterally, the door can now be removed from the door frame. By reversing the foregoing operation, the door can be replaced. The bottom of each of the doors 54, 66 is provided with a depending bar 54*a* which normally is seated in the groove 56 to retain the doors in closed position.

The cabinet 70 is provided with side walls 72, 74 and a rear wall 76. The bottom wall 78 is secured to the side walls 72, 74 and rear wall 76 by seating in grooves in these respective walls.

The side walls 72, 74 are provided with cutouts 80, 82 whereby the free front edges of the side walls will seat in grooves 13, 15, 37 and 39 and be anchored by force fitting therein by tapered pins 84 inserted in the perforations of ears 12*b*, 12*c*, 14*b*, 14*c*, 36*a* and 38*b* and in opposed openings 74*a*, 74*b*, 74*c*, 72*a*, 72*b* and 72*c* in the side walls 72 and 74, respectively.

The free forward end of bottom wall 78 will lie on the wall 20.

The side walls are additionally supported by cleats 86 stapled or otherwise secured to the side walls 72, 74 at the upper and lower ends thereof. (See FIGS. 3, 5 and 7.) Each cleat contains an aperture for the reception of headed bolts 88 to which wing nuts 90 are secured. The bolts are threaded through an aperture in the rear wall 76 aligned with the aperture in the cleat. Thus the rear wall is secured to the side walls.

As shown in the drawings, the tapered pins 84, the wing nuts 90 and bolts 88 may be removed without tools, the side walls removed from the grooves and thus the entire cabinet is knocked down for easy storage and shipping.

The upper end of the cabinet is open, as shown in FIG. 12, to receive the usual washbowl and an appropriate opening 92 is cut out of the rear wall for the entrance of hot and cold water piping and drain piping (not shown).

It should now also be apparent that the lower front end of the door frame is provided with toe room for the user and prevent marring of the lower end of the cabinet. Also, the upper front wall 10 may be decorative.

Each door 54, 56 is provided with handles 94, 96 molded in the door for opening the doors.

Although but one specific embodiment of this invention is herein shown and described, it will be understood that details of the construction shown may be altered or omitted without departing from the spirit of the invention as defined by the following claims.

I claim:

1. A knockdown cabinet having side, rear and bottom walls, a combination one-piece door frame and front wall, and doors for said frame, said combination front wall and door frame being plastic molded in one piece and comprising a narrow top wall, outer side walls and a bottom wall, said bottom wall being wide, inner walls spaced from each of said walls to form grooves whereby the forward free ends of the side walls of the cabinet seat therein, a plurality of spaced perforated ears extending from the free edges of said inner side wall, said cabinet side walls having a series of perforations therein in opposed relationship with the perforations in each of said ears, means to secure said cabinet side walls to said ears, means for pivoting said doors in said frame, and means for positively positioning said doors in closed position and providing for the ready removal and replacement of said doors.

2. The device according to claim 1 wherein the lower ends of said side walls of said frame are offset, and a wall depends from the margin of said wide bottom wall and extends between the margins of said offset side walls.

3. The device according to claims 2 wherein said offset side walls are each provided with a groove to receive the offset free forward end of the lower end of said cabinet side wall.

4. The device according to claim 2 wherein said cabinet rear wall is grooved to receive one end of the cabinet bottom wall, the opposite end of the bottom wall lays on said bottom wide wall of said frame, and abuts the bottom wall of said frame.

5. The device according to claim 1 wherein said means to pivot the doors comprises tapered brackets molded to the bottom wide wall and positioned thereon, one adjacent each frame side wall, each of said brackets containing a vertically-disposed perforation therein and a pair of grooves each extending from said perforation, one extending laterally towards the other bracket and the other at right angles thereto, an intermediate horizontal wall having spaced perforations aligned with the perforation in each of said brackets, and aligned upper and lower pivot pins in each of said doors for seating in respective perforations of said bracket.

6. The device according to claim 5 wherein each of said doors has a bar extending from said lower pivot pin aligned with one of said grooves in said bracket for seating therein.

7. The device according to claim 6 wherein each of said lower pivots is provided with a pair of flat faces.

8. A combination front wall and door frame for a cabinet being plastic molded in one piece comprising a top wall, side walls and a horizontally positioned bottom wall, said bottom wall being wide, a tapered bracket molded to said bottom wall, adjacent a side wall, said bracket containing a vertically disposed perforation therein, a pair of grooves each extending from said perforation, one extending laterally towards the opposed side wall and the other at right angles thereto, a perforation in said top wall aligned with the perforation in said bracket, a door for said frame, having aligned pivot pins for seating in respective perforations in said bracket and top wall; whereby said combination of a front wall and door frame is arranged to be secured to the front of cabinet side walls.

* * * * *